US009945367B2

(12) United States Patent
Wang

(10) Patent No.: US 9,945,367 B2
(45) Date of Patent: Apr. 17, 2018

(54) DUAL-GAUGE AIR PUMP

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 197 days.

(21) Appl. No.: 14/977,277

(22) Filed: Dec. 21, 2015

(65) Prior Publication Data

US 2016/0108907 A1 Apr. 21, 2016

(30) Foreign Application Priority Data

Mar. 20, 2013 (TW) ..... 102109896 A

(51) Int. Cl.
*F04B 33/00* (2006.01)

(52) U.S. Cl.
CPC ..... *F04B 33/005* (2013.01)

(58) Field of Classification Search
CPC ..... F04B 33/005
See application file for complete search history.

(56) References Cited

U.S. PATENT DOCUMENTS

| | | | |
|---|---|---|---|
| 2,394,987 A | 2/1946 | Deming | |
| 2,717,573 A | 9/1955 | Murray | |
| 5,167,250 A | 12/1992 | Barbieri | |
| 5,779,457 A | 7/1998 | Chaung et al. | |
| 2004/0001761 A1 | 1/2004 | Wu | |
| 2016/0231185 A1* | 8/2016 | Wu | F04B 33/00 |

* cited by examiner

*Primary Examiner* — Patrick Hamo
(74) *Attorney, Agent, or Firm* — Muncy, Geissler, Olds & Lowe, P.C.

(57) ABSTRACT

A dual-gauge air pump has two round dial pressure gauges that are configured in a back-to-back arrangement, i.e. 180 degrees to each other, and to rotate through 360 degrees simultaneously for a user's easy observation.

2 Claims, 6 Drawing Sheets

DUAL-GAUGE AIR PUMP

RELATED APPLICATION

This application is a continuation-in-part (CIP) application of Ser. No. 13/926,431 filed Jun. 25, 2013 entitled, "AIR PUMP WITH TWO PRESSURE GAUGES FOR HIGH/LOW PRESSURE INDICATION".

BACKGROUND OF THE INVENTION

1. Technical Field

The present invention relates to manual air pumps, and more particularly to a dual-gauge air pump.

2. Description of Related Art

U.S. Pat. No. 5,779,457 discloses a mini manual pump that having low- and high-pressure gauges. Each of the gauges has a bar-like shape and very fine calibrations. In use, a user read a pressure value by visually determining a present site of the moving piston in one of the narrow windows and identifying the corresponding calibration. This is particularly challenging to users having poor vision. Also, the two juxtaposed gauges may cause confusion to users about which one is to be read right now.

SUMMARY OF THE INVENTION

The primary objective of the present invention is to provide a dual-gauge air pump whose pressure value is convenient and easy to read.

To achieve the foregoing objective, the disclosed dual-gauge air pump features for two round dial pressure gauges that are configured in a back-to-back arrangement, i.e. 180 degrees to each other, and to be rotate through 360 degrees simultaneously for a user's easy observation.

DETAILED DESCRIPTION OF THE INVENTION

Figure 1:
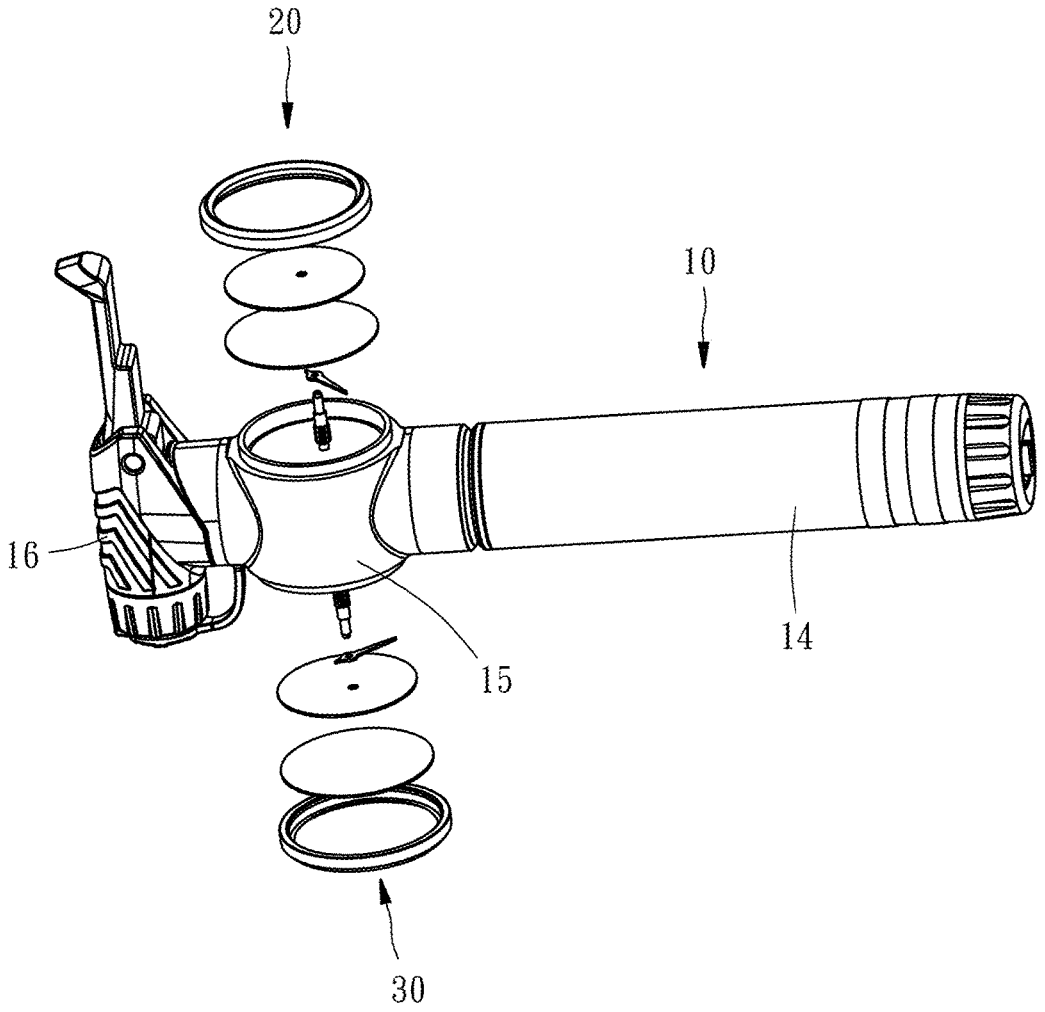
FIG. 1 is an exploded view of the first embodiment of present invention.
Figure 2:
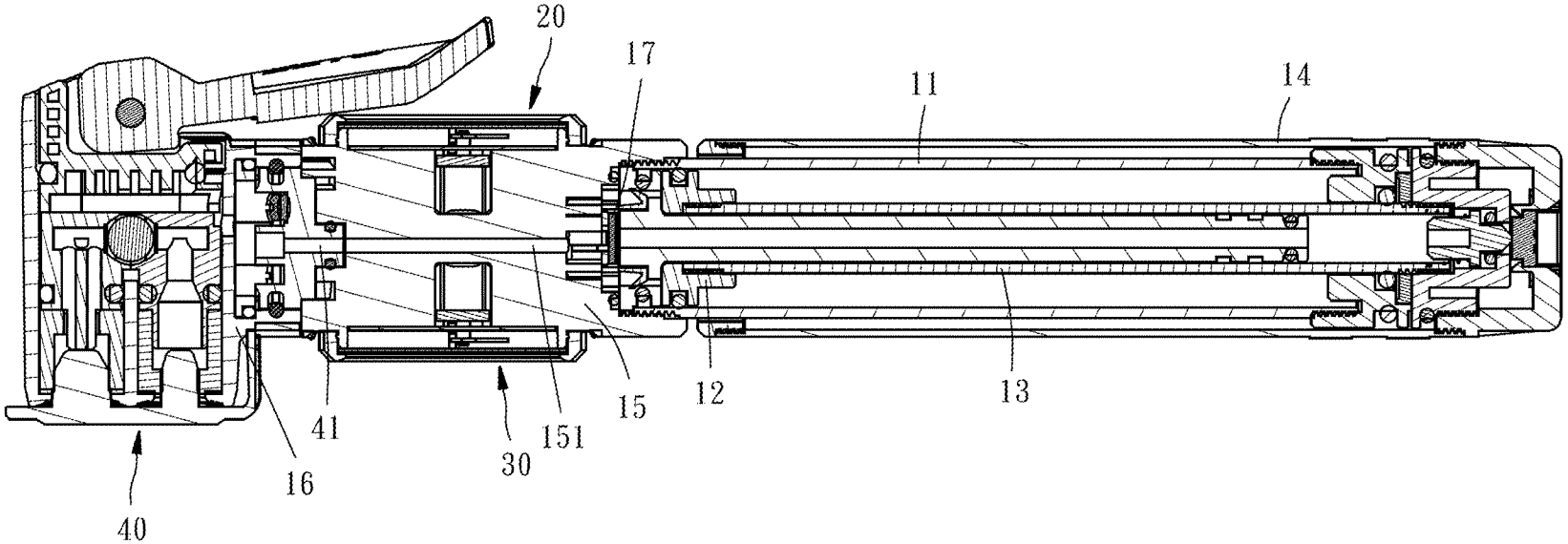
FIG. 2 is a cross-sectional view of the first embodiment of present invention.
Figure 3:
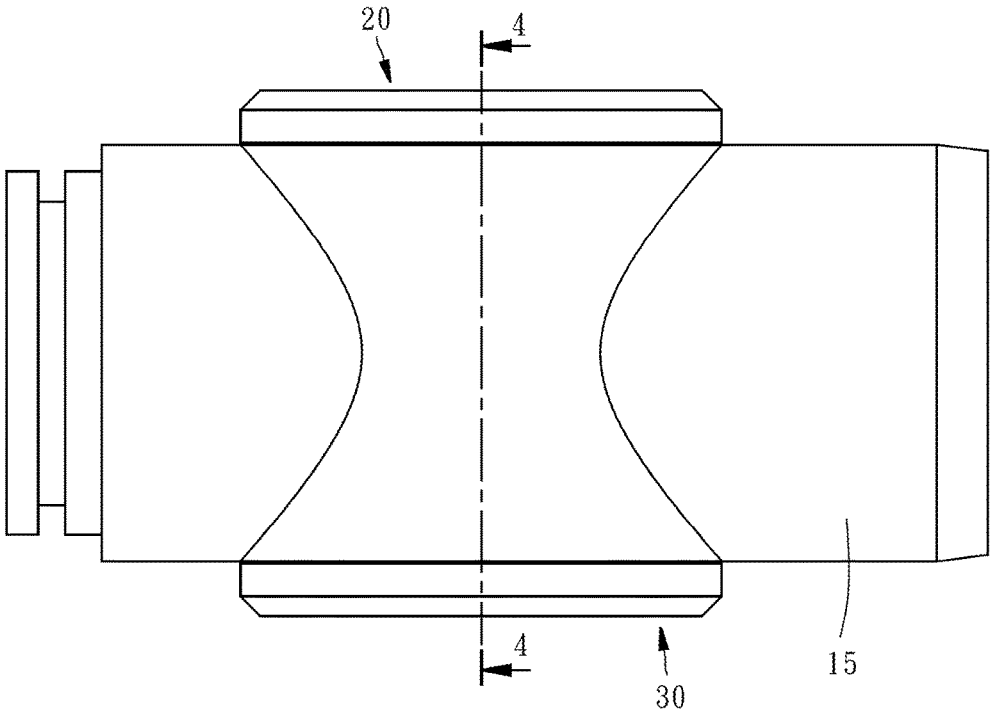
FIG. 3 is a side view of a portion of the first embodiment of present invention.
Figure 4:
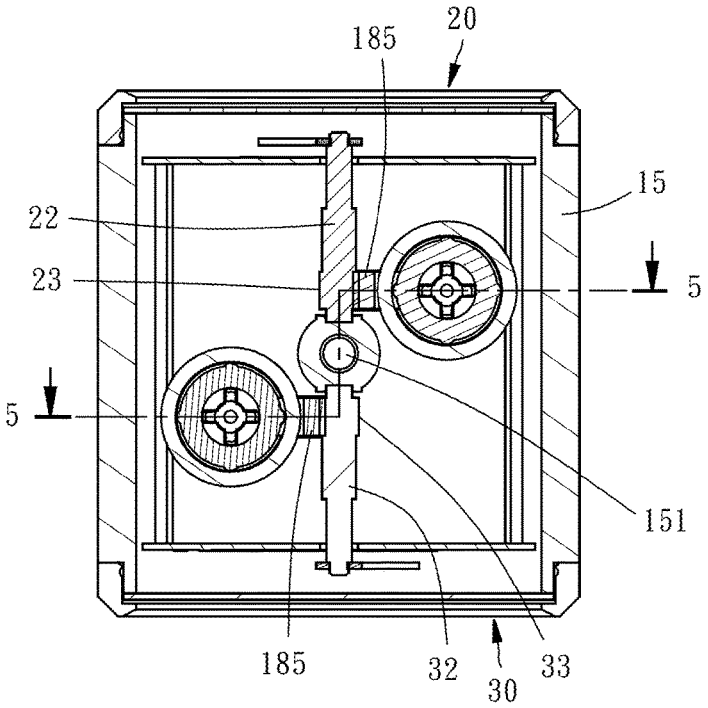
FIG. 4 is a cross-sectional view along the 4-4 line in FIG. 3.
Figure 5:
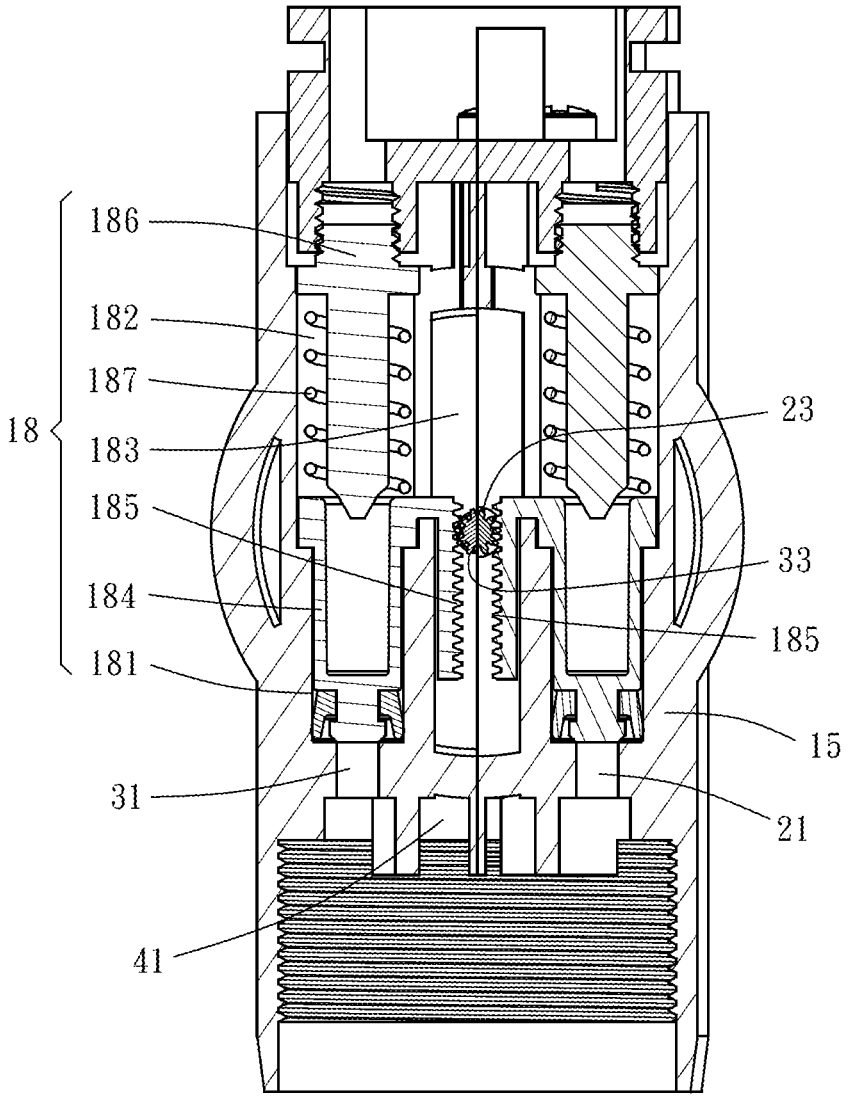
FIG. 5 is a cross-sectional view along the 5-5 line in FIG. 4.

For further illustrating the present invention, two preferred embodiments are described below with reference to the accompanying drawings.

Referring to FIG. 1 through FIG. 5, according to the first embodiment of the present invention, a mini air pump (10) comprises:

a barrel (11);

a piston (12), installed in the barrel (11);

pumping shaft (13), having one end fixed to the piston (12) and an opposite end jutting out one end of the barrel (11);

a handle (14), being fixed to an opposite end of the pumping shaft (13);

a gauge casing (15), having one end fixed to an opposite end of the barrel (11) and being provided with two round dial pressure gauges (20)(30), in which one is a high-pressure gauge (20) and the other is a low-pressure gauge (30), wherein the two pressure gauges (20)(30) are on each other's back, facing the exterior, and communicated with the barrel (11) through air paths (21)(31) respectively; and a nozzle casing (16), being pivotally connected to an opposite end of the gauge casing (15) and freely rotatable through 360 degrees, containing therein a nozzle assembly (40), and being communicated with the barrel (11) through an air path (41). The gauge casing (15) is provided at an inside thereof with a main air path (151) penetrating through two ends of the gauge casing (15). The main air path (151) has an end communicated with the nozzle casing (16) via a check valve (17) and the other end communicated with the nozzle casing (16). The gauge casing (15) is provided at an inside thereof with two piston-type pressure detecting units (18), each of which comprises a piston cylinder (181) having an end communicated with the main air path (151) via an air path (31), an accommodation chamber (182) coaxially arranged with the piston cylinder (181) and having an end that is communicated with the other end of the piston cylinder (181), and a lateral side provided with a notch (183), a piston (184) disposed in the piston cylinder (181) and provided with a rack gear (185) extending outwardly from an end of the piston (184) through the notch (183) of the accommodation chamber (182), a positioning member (186) fixedly mounted to the other end of the accommodation chamber (182), and a spring (187) having an end fixed to the positioning member (186) and the other end coupled to the piston (184). The two rack gears (185) of the two pressure detecting units (18) are engaged with gears (23)(33) of indicator shafts (22)(32) of the two pressure gauges (20)(30), respectively. The two springs (187) of the two pressure detecting units (18) have different coefficients of elasticity.

Before use, a user decides whether the high-pressure gauge or the low-pressure gauge is used, and makes the selected gauge face him/her. Then the user can connect the nozzle (40) to a valve provided on an object to be inflated. The use is convenient. Additionally, since the gauges are round dial pressure gauges, the indication is very clear and can be easily read by the user.

Figure 6:
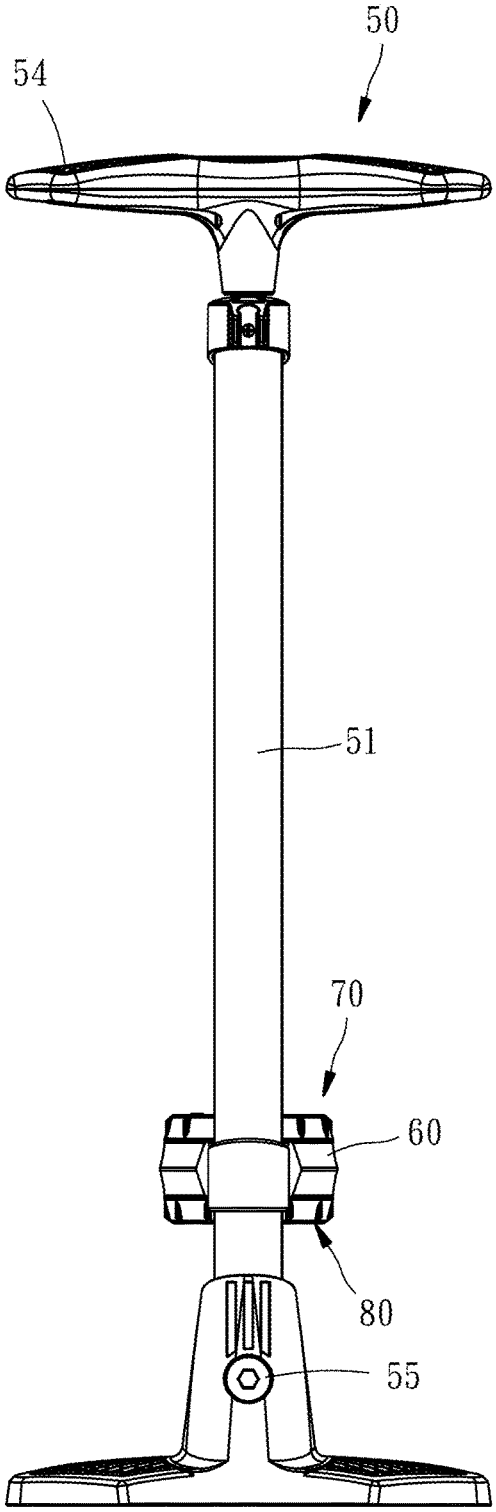
FIG. 6 is a front view of the second embodiment of present invention.
Figure 7:
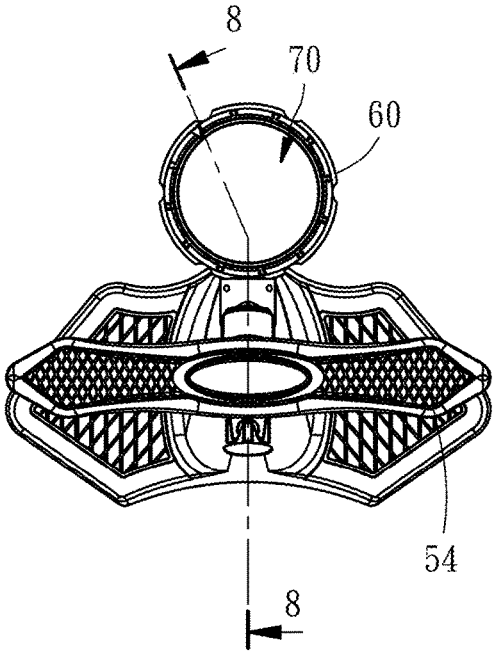
FIG. 7 is a top view of the second embodiment of present invention.
Figure 8:
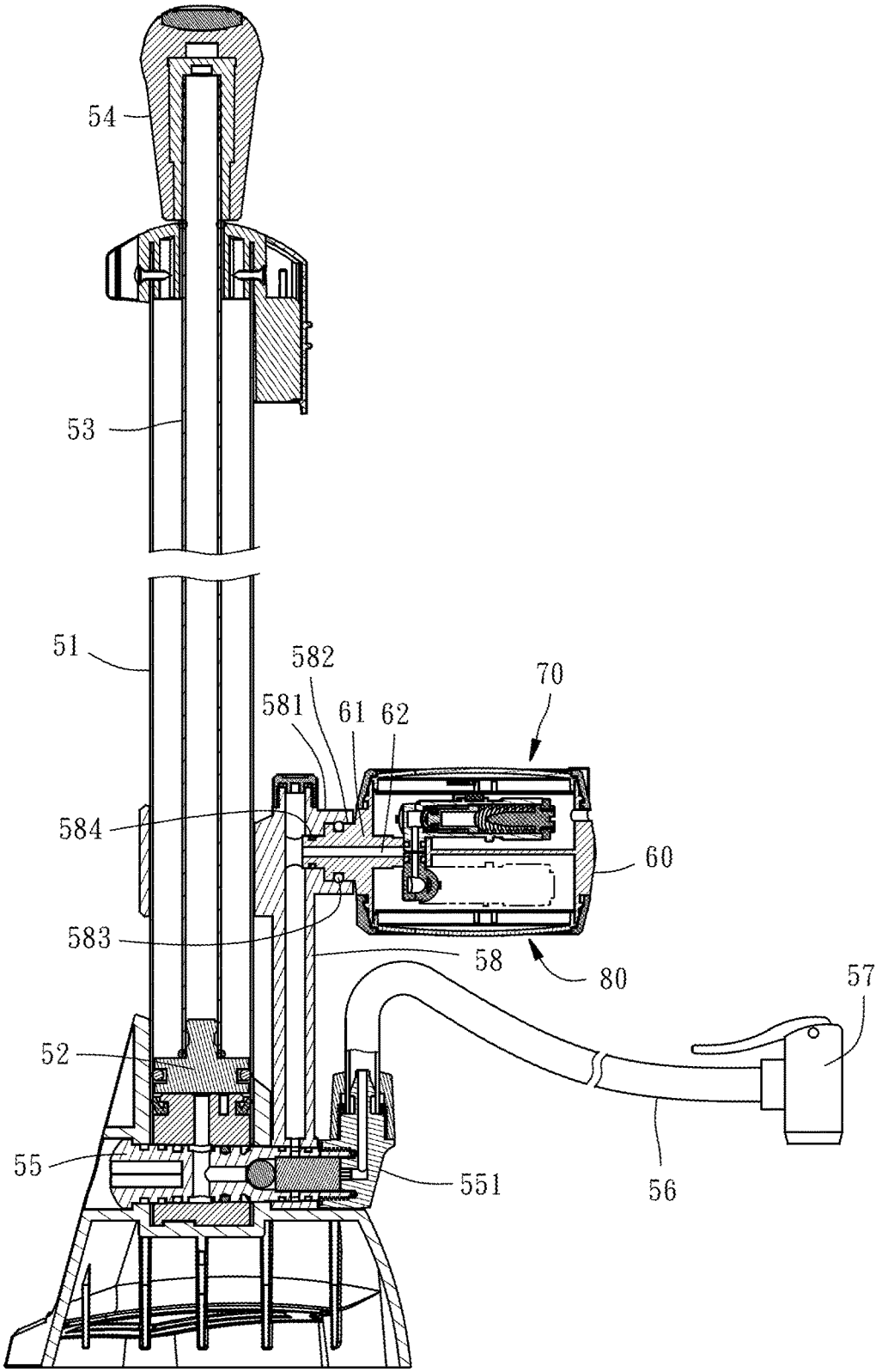
FIG. 8 is a cross-sectional view along the 8-8 line in FIG. 7

As shown in FIG. 6 through FIG. 8, in the second embodiment of the present invention, a floor pump (50) comprises:

a barrel (51);

a piston (52), installed in the barrel (51);

a pumping shaft (53), having one end fixed to the piston (52) and an opposite end jutting out one end of the barrel (51);

a handle (54), being fixed to an opposite end of the pumping shaft (53);

an air guide (55), being installed in a bottom of the barrel (51) and having an exposed end (551);

a hose (56), having one end fixed to an exposed end (551) of the air guide (55);

a nozzle (57), being fixed to an opposite end of the hose (56);

an air-guiding path (58), having an elongated tube shape and arranged in parallel with the barrel (51), the air-guiding path (58) having a bottom end communicated with the air guide (55); and a gauge casing (60), being provided with two round dial pressure gauges (70)(80), in which one is a high-pressure gauge (70) and the other is a low-pressure gauge (80) that are on each other's back and facing the exterior, and having a post (61) that is integrally formed at a lateral side of the gauge casing (60) and formed centrally an air path (62) running from the exterior to the interior, wherein the two dial pressure gauges (70)(80) are communicated with the air path (62) respectively and the gauge casing (60) has its post (61) pivotally connected to the air-guiding path (58) so as to be freely rotatable through 360 degrees. The air-guiding path (58) is provided at a top end thereof with a protruded coupling portion (581) having a coupling groove (582) communicated with a tube hole of the air-guiding path (58). The post (61) is inserted into the coupling groove (582) of the coupling portion (581) and a positioning member (583), which is realized by one or two pins in this embodiment, is inserted in and between the contact surfaces of the coupling groove (582) and the post (61) in a way that the gauge casing (60) is freely rotatable through 360 degrees without escaping from the coupling portion (581). The post (61) is disposed with a sealing ring (584) at a location in front of the positioning member (583) for preventing air leaking.

Thereby, a user can rotate the gauge casing (60) to conveniently select whether he/she uses the high-pressure gauge (70) or the low-pressure gauge (80).

What is claimed is:

1. A dual-gauge air pump comprising:

a barrel;

a piston, being installed in the barrel;

a pumping shaft, having a first end fixed to the piston and a second end being opposite from the first end of the pumping shaft and jutting out a first end of the barrel;

a gauge casing, having a first end fixed to a second end of the barrel opposite from the first end of the barrel and being provided with two round dial pressure gauges, in which one is a high-pressure gauge and the other is a low-pressure gauge, wherein the two pressure gauges are on each other's back, facing the exterior, and communicated with the barrel through respective air paths; and a nozzle casing, being pivotally connected to a second end of the gauge casing opposite from the first end of the gauge casing and freely rotatable through 360 degrees, containing therein a nozzle assembly, and being communicated with the barrel through an air path;

wherein the gauge casing is provided at an inside thereof with a main air path penetrating through the first and second ends of the gauge casing;

wherein the main air path of the gauge casing has an end communicated with the nozzle casing via a check valve, and the other end communicated with the nozzle casing;

wherein the gauge casing is provided at the inside thereof with two piston-type pressure detecting units, each of which comprises a piston cylinder having an end communicated with the main air path via an air path, an accommodation chamber coaxially arranged with the piston cylinder and having an end that is communicated with the other end of the piston cylinder, and a lateral side provided with a notch, a piston disposed in the piston cylinder and provided with a rack gear extending outwardly from an end of the piston through the notch of the accommodation chamber, a positioning member fixed mounted to the other end of the accommodation chamber, and a spring having an end fixed to the positioning member and the other end coupled to the piston;

wherein the two rack gears of the two pressure detecting units are engaged with a gear of an indicator shaft of one of the two pressure gauges and a gear of an indicator shaft of the other of the two pressure gauges, respectively;

wherein the two springs of the two pressure detecting units have different coefficients of elasticity.

2. A dual-gauge air pump comprising:

a barrel;

a piston, being installed in the barrel;

a pumping shaft, having a first end fixed to the piston and a second end being opposite from the first end and jutting out one end of the barrel;

a handle, being fixed to an opposite end of the piston;

an air guide, being installed in the barrel and having an exposed end;

a hose, having a first end and a second end, the first end being connected to the exposed end of the air guide;

a nozzle, being fixed to the second end of the hose opposite from the first end of the hose;

an air-guiding path, having an elongated tube shape and arranged in parallel with the barrel, the air-guiding path having a bottom end communicated with the air guide; and a gauge casing, being provided with two round dial pressure gauges, in which one is a high-pressure gauge and the other is a low-pressure gauge that are on each other's back and facing the exterior, and having a post that is integrally formed at a lateral side of the gauge casing and formed centrally an air path running from the exterior to the interior, wherein the two dial pressure gauges are communicated with the air path respectively and the gauge casing has its post pivotally connected to the air-guiding path so as to be freely rotatable through 360 degrees;

wherein the air-guiding path is provided at a top end thereof with a protruded coupling portion having a coupling groove communicated with a tube hole of the air-guiding path;

wherein the post is inserted into the coupling groove of the coupling portion and a positioning member is inserted in and between contact surfaces of the coupling groove and the post in a way that the gauge casing is freely rotatable through 360 degrees without escaping from the coupling portion;

wherein the post is disposed with a sealing ring at a location in front e positioning member.

* * * * *